United States Patent [19]

Asselin et al.

[11] 4,083,772

[45] Apr. 11, 1978

[54] AROMATIC HYDROCARBON SEPARATION PROCESS

[75] Inventors: George F. Asselin, Mount Prospect; Paul A. Witt, Arlington Heights, both of Ill.

[73] Assignee: UOP Inc., Des Plaines, Ill.

[21] Appl. No.: 706,853

[22] Filed: Jul. 19, 1976

[51] Int. Cl.[2] ..... C10G 21/28

[52] U.S. Cl. ..... 208/321; 260/674 SE

[58] Field of Search ..... 208/321; 260/674 SE

[56] References Cited

U.S. PATENT DOCUMENTS

| | | | |
|---|---|---|---|
| 2,730,558 | 1/1956 | Gerhold | 208/321 |
| 3,173,966 | 3/1965 | Jones et al. | 260/674 SE |
| 3,396,101 | 8/1968 | Broughton | 208/318 |
| 3,492,222 | 1/1970 | Van Tassell | 208/321 |

*Primary Examiner*—Herbert Levine

*Attorney, Agent, or Firm*—James R. Hoatson, Jr.; Robert W. Erickson; William H. Page, II

[57] ABSTRACT

A solvent extraction process for separating polar hydrocarbons from non-polar hydrocarbons. The solvent-rich extract phase is introduced into a stripping column through two separated loci; the bottoms from the stripping column, a polar hydrocarbon-containing, solvent-rich stream, is introduced into an upper portion of the solvent recovery column. Polar hydrocarbons in concentrated form are recovered as an overhead stream, a lean solvent stream, virtually free from hydrocarbons, is withdrawn as a bottoms product and recycled in part to the extraction zone, and admixed in part with that portion of the extract phase introduced into the upper of the two separated loci. An internally prepared vaporous stripping medium is introduced into the lower portion of the solvent recovery column.

10 Claims, 1 Drawing Figure

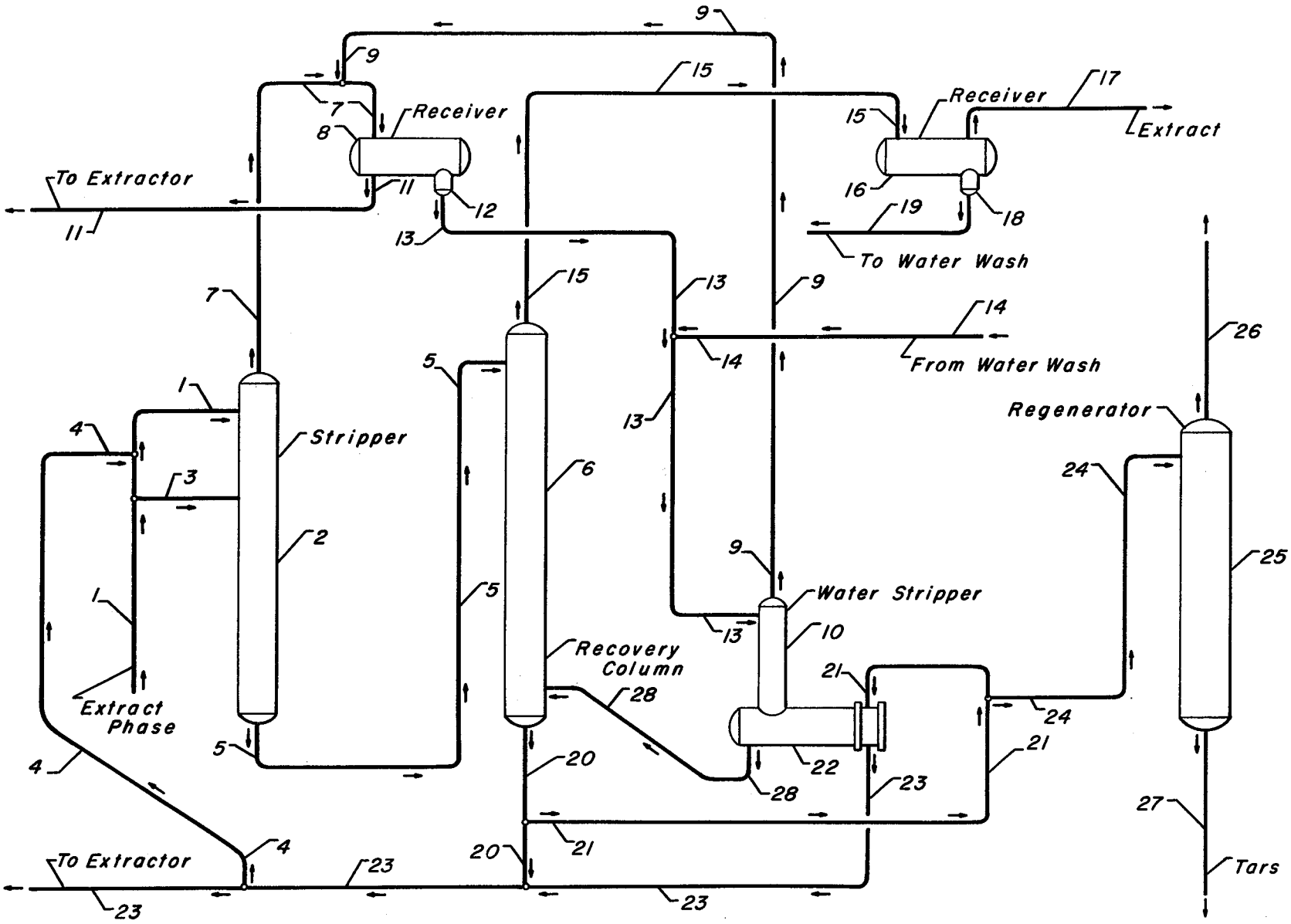
Extract
Receiver
To Water Wash
From Water Wash
Regenerator
Tars
Water Stripper
Recovery Column
Receiver
Stripper
To Extractor
Extract Phase
To Extractor

AROMATIC HYDROCARBON SEPARATION PROCESS

APPLICABILITY OF THE INVENTION

As herein described, the present invention is intended for use in the separation and ultimate recovery of polar hydrocarbons from non-polar hydrocarbons, which separation is effected through the use of a solvent characteristically selective for absorbing polar hydrocarbons. More specifically, our invention is directed toward the separation and recovery of aromatic hydrocarbons from various mixtures thereof with non-aromatic hydrocarbons. The use herein of the terms "polar" and "non-polar" is intended to distinguish between classes of hydrocarbons wherein one particular type is more polar than the other. For example, in an extraction process intended to recover naphthenes from a mixture thereof with paraffins, the former are "polar" and the latter "non-polar". When extracting aromatics from a mixture thereof with naphthenes and paraffins, the latter are considered "non-polar" with respect to the aromatic hydrocarbons which are "polar".

In one of its specific applications, the separation process evolved from the present invention serves to segregate particular species of aromatic hydrocarbons such as benzene, toluene and/or $C_8$-aromatics from other hydrocarbons generally found in petroleum fractions and distillates. The process utilizes a solvent which may be indefinitely recycled throughout the system, yields the desired product in high purity and separates the same substantially in its entirety from the feedstocks charged to the process. Our invention is particularly applicable as an improvement in the type of separation process wherein a mixture of various classes of hydrocarbons is introduced into a solvent extraction zone, generally at an intermediate locus in the height thereof, and is countercurrently contacted with a solvent selective for automatic hydrocarbon adsorption. A raffinate phases, comprising substantially all of the non-aromatic hydrocarbons in the feedstock, is removed from one end portion of the extraction zone at which the solvent is introduced. An extract phase, comprising the aromatic components of the feedstock, the selected solvent and some non-aromatic components, is removed from the other end portion of the extraction zone, and the aromatic solute is substantially recovered by stripping and fractionating the extract phase.

Although applicable for utilization with any hydrocarbon feedstock having a sufficiently high aromatic concentration to justify the recovery thereof—e.g. from about 15.0 to about 50.0% by volume—distinct advantages are afforded when processing those feedstocks having an aromatic concentration of about 60.0 to about 75.0 % by volume. Exemplary of various sources of suitable charge stocks are the depentanized effluent from a catalytic reforming unit, wash oils, and especially coke oven by-products and hydrotreated pyrolysis naphthas.

Briefly, the present inventive concept involves introducing portions of a mixture of polar hydrocarbons, non-polar hydrocarbons and the characteristically selective solvent into a first fractionation column (stripping column) through two separated loci. The bottoms, a solvent-rich polar hydrocarbon-containing stream is introduced into a second fractionating column (solvent recovery column), from which a hydrocarbon-containing, solvent-rich stream is withdrawn as a bottoms product. The greater proportion of the solvent-rich stream is recycled to the original extraction zone; however, in accordance with the present separation process, from about 5.0 to about 30.0% by volume is introduced into the first fractionation column in admixture with the portion of extract phase being introduced through the upper locus. A vaporous medium is introduced into the bottom section of the second fractionation column to enhance recovery of substantially aromatic hydrocarbon-free solvent as the bottoms stream.

PRIOR ART

It must be recognized that the prior art proliferates in a wide spectrum of solvent extraction techniques intended to effect the separation of aromatic hydrocarbons from a mixture with non-aromatic hydrocarbons. No attempt will be made herein to delineate exhaustively the appropriate published literature; it will suffice simply to note several examples which appear to be exemplary of various prior art practices, and to which the present invention is applicable. The majority of solvent extraction processes indicate a distinct preference for a water-soluble solvent comprising an oxygenated organic compound. A review of the relevant prior art indicates that the prevalent solvent is either a sulfolane-type organic compound, or an alkylene glycol and preferably a polyalkylene glycol. While most prior art processes are intended for utilization with either of the water-soluble solvents, specific techniques have been illustrated in the past which are peculiar either to one, or the other.

The use of a light paraffin backwash stream in the solvent extraction column, to displace heavier non-aromatic components from the extract phase, is shown in U.S. Pat. No. 3,037,062 (Cl. 260–674), issued May 29, 1962. The aromatic concentrate is recovered as a side-cut from the stripping column and subsequently introduced into fractionation facilities for separation into the individual aromatic components. The rectification of a solvent-rich side-cut from the stripping zone is disclosed in U.S. Pat. No. 3,173,966 (Cl. 260–674), issued Mar. 16, 1965. This technique affords the recovery of substantially solvent-free water for subsequent utilization within the process.

U.S. Pat. No. 3,396,101 (Cl. 208–313), issued Aug. 6, 1968, involves introducing a mixture of charge stock and lean solvent into the stripping column from which a non-aromatic overhead stream is withdrawn and introduced into the extraction zone. The resulting rich solvent is passed from the extraction zone to the stripping column as a second feed stream thereto. The bottoms from the stripping column is introduced into a solvent recovery zone, the recovered solvent being withdrawn as a single bottoms stream for recycle in part to the extraction zone and in part to the stripping column. The key feature of the illustrated and claimed process involves charging the original hydrocarbon feed to the stripping column as contrasted to the solvent extraction zone. The principal utility of this technique resides in the processing of narrow boiling range feedstocks such as a $C_8$-hydrocarbon heart-cut, and not in the simultaneous recovery of a more broad range of aromatics—e.g. benzene, toluene and xylene ($C_6$ through $C_8$). As a result, the major portion of the lean solvent from the recovery column is introduced into the stripping column; only enough is recycled to the extraction zone to effect the recovery of aromatics from the condensed stripping column overhead. The stripping column must distill all non-aromatics overhead without taking too much aromatics. Solvent provides selectivity between aromatics and saturates both in the extraction zone and in the stripping column; however, with respect to the latter, the effective selectivity is actually the relative volatility between aromatics and saturates, and this is greatly influenced by vapor pressure, or boiling point. In order for the illustrated prior art process to be capable of handling a benzene-toluene-xylene feed stream, all of the heaviest saturates—e.g. $C_9$-paraffins—must go overhead without taking too much benzene. This is extremely difficult without employing greatly excessive quantities of solvent; thus, the illustrated process is practically limited to a heart-cut feed stream. In the process of the present invention, the heavier saturates are removed in the solvent extraction zone.

In U.S. Pat. No. 3,436,435 (Cl. 260–674), issued Apr. 1, 1969, an aromatic side-cut is withdrawn from the stripping column, introduced into an entrainment separator from which an aromatic concentrate is subsequently transported to fractionation facilities. A solvent-containing bottoms stream is withdrawn from the entrainment separator and reintroduced into an intermediate locus of the stripping column.

Still another variation is that found in U.S. Pat. No. 3,723,256 (Cl. 203–43), issued Mar. 27, 1973. Initially, the aromatic hydrocarbon feed is introduced into a distillation column from which a light fraction and a heavier bottoms fraction are recovered. The former is passed into an extractive distillation tower while the latter is introduced into a liquid extraction unit. The extract from the liquid extraction unit is stripped of non-aromatic hydrocarbons to produce a non-aromatics-free fraction and non-aromatics-containing fraction. The aromatic stream recovered in admixture with the solvent, from the extractive distillation column, is passed to a recovery section in admixture with the aromatic-containing fraction from the stripping zone. The overhead stream from the extractive distillation column and the non-aromatics from the stripping zone are passed in admixture to the bottom section of the solvent extraction zone, to function therein as a reflux stream.

U.S. Pat. No. 3,466,346 (Cl. 260–674), issued Sept. 9, 1969, is specifically directed toward the separation of the extract phase from the solvent extraction zone. The technique involves withdrawing, from both the extractive distillation column and the aromatic recovery distillation column, a side-cut fraction. With respect to the extractive distillation column, the side-cut fraction is introduced as a vapor directly into the aromatic recovery column. The side-cut fraction from the aromatic recovery column, being a lean solvent stream containing aromatic hydrocarbons, is returned to the extractive distillation column in admixture with the extract phase introduced thereto.

The utilization of the present inventive concept significantly decreases the quantity of aromatic hydrocarbons in the overhead stream from the stripping column which, after the removal of water, constitutes reflux to the bottom of the extraction zone. Also, the use of an internally prepared stripping medium, in the lower portion of the solvent recovery column, decreases the quantity of hydrocarbons remaining in the lean solvent stream withdrawn therefrom. Since this lean solvent stream is recycled in part to the solvent extraction zone, the efficiency of separation effective therein is further enhanced.

OBJECTS AND EMBODIMENTS

A principal object of our invention is to enhance and facilitate the recovery of polar hydrocarbons from a mixture thereof with non-polar hydrocarbons. A corollary objective resides in a method for separating the polar hydrocarbons from a mixture thereof with non-polar hydrocarbons and a solvent characteristically selective for absorbing the polar hydrocarbons.

A specific object is to effect a reduction in the cost of utilities (energy savings) while separating aromatic hydrocarbons from a mixture thereof with non-aromatic hydrocarbons and the selective solvent without detrimentally affecting the efficiency with which aromatic hydrocarbons are originally extracted from the mixture thereof with non-aromatic hydrocarbons.

Therefore, one embodiment of our invention is directed toward a method for separating polar hydrocarbons from a mixture thereof with non-polar hydrocarbons and a solvent characteristically selective for absorbing polar hydrocarbons, which method comprises the steps of: (a) introducing a first portion of said mixture into a first fractionation column, through a first locus in the upper portion thereof, and a greater second portion of said mixture through a second locus in the upper portion of said first column, said second locus being below said first locus; (b) removing a non-polar hydrocarbon stream from said first fractionation column, through a third locus disposed above said first locus and withdrawing a solvent-rich, polar hydrocarbon-containing stream through a fourth locus in the lower portion of said first column; (c) introducing at least a portion of said solvent-rich, polar hydrocarbon-containing stream into a second fractionation column, through a first locus in the upper portion of said column, removing a polar hydrocarbon-rich stream, substantially free from solvent and non-polar hydrocarbons, through a second locus in the upper portion thereof, said second locus being above said first locus, and introducing a vaporous stripping medium through a third locus in the lower portion of said second column, and withdrawing a solvent-rich stream, substantially free from hydrocarbons, through a fourth locus disposed below said third locus; and, (d) introducing at least a portion of said solvent-rich stream into said first fractionation column through said first locus in admixture with the first portion of said mixture.

In a specific embodiment, our inventive concept encompasses a process for the recovery of aromatic hydrocarbons from a mixture thereof with non-aromatic hydrocarbons, which process comprises the sequential steps of: (a) introducing said mixture into an extraction zone and therein contacting said mixture with a solvent characteristically selective for absorbing aromatic hydrocarbons, at conditions selected to maintain said mixture and solvent in liquid phase; (b) removing the non-aromatic raffinate stream from said zone, through an upper locus thereof, and an aromatic hydrocarbon, solvent-rich extract stream from a lower locus of said zone; (c) introducing a first portion of said extract stream into a stripping column, through a first locus in the upper portion thereof, and a greater second portion of said extract stream through a second upper locus in the upper portion of said first column, said second locus being below said first locus; (d) removing a non-aromatic, solvent-containing stream from said stripping column, through a third locus disposed above said first locus, and withdrawing a solvent-rich, aromatic-containing stream through a fourth locus in the lower portion of said column; (e) introducing at least a portion of said solvent-rich, aromatic-containing stream into a recovery column, through a first locus in the upper portion of said column, removing an aromatic-rich stream, substantially free from solvent and non-aromatic hydrocarbons, through a second locus disposed above said first locus, introducing a vaporous stripping medium through a third locus in the lower portion of said recovery column, and withdrawing a solvent-rich stream, substantially free from hydrocarbons, through a fourth locus disposed below said third locus; (f) introducing a first portion of said solvent-rich stream into said stripping column, through said first locus in admixture with the first portion of said extract stream, and recycling a second portion of said solvent-rich stream to said extraction zone; and, (g) recovering solvent from said non-aromatic solvent-containing stream and introducing the recovered solvent into said recovery column as said stripping medium.

Other objects and embodiments of our invention will become evident from the following more detailed description thereof. One such other embodiment, from about 5.0 to about 30.0% of the solvent-rich stream recovered from the solvent recovery column is introduced into the stripping column in admixture with the first portion of the extract stream.

SUMMARY OF INVENTION

As hereinbefore set forth, the technique encompassed by our inventive concept is intended for integration into a solvent extraction process for the selective separation and recovery of polar hydrocarbons from a mixture thereof with non-polar hydrocarbons. Although thus applicable to a multitude of hydrocarbon mixtures, the following discussion will be directed primarily to the separation and recovery of aromatic hydrocarbons from a mixture thereof with paraffins and/or naphthenes. As generally practiced, the mixture of hydrocarbons is contacted with a water-soluble, oxygen-containing solvent characteristically selective for the extraction of polar hydrocarbons. There is recovered, from the solvent extraction zone, an extract stream containing aromatic hydrocarbons in a major proportion of the water-soluble solvent, and a raffinate stream containing non-aromatic hydrocarbons and a relatively minor proportion of the water-soluble solvent. The raffinate stream is generally contacted, in countercurrent flow, with water to recover the solvent and to provide a non-aromatic hydrocarbon concentrate which is substantially free from solvent.

The extract phase, removed from a lower portion of the solvent extraction column, is introduced into the upper portion of a stripping column, the principal function of which is to remove non-aromatic hydrocarbons in an overhead stream. This overhead stream will be a hydrocarbon concentrate containing some solvent and water. It is introduced into a so-called overhead stripper receiver for separation into a hydrocarbon phase and a solvent/water phase. The hydrocarbon phase, substantially free from solvent and water is introduced into the lower portion of the extraction zone as reflux thereto. The solvent/water phase is conveniently combined with the substantially hydrocarbon-free solvent/water phase from the raffinate water-wash column, the mixture being introduced into the upper portion of a water stripping column.

The solvent-rich, aromatic concentrate, substantially free from non-aromatic hydrocarbons, withdrawn from the lower portion of the stripping column, is generally introduced into the upper, central portion of a solvent recovery column. An aromatic concentrate, containing water and being substantially free from solvent, is withdrawn as an overhead stream from the recovery column and introduced into an overhead receiver. The overhead receiver serves to effect a phase separation between the aromatic hydrocarbons, which are recovered, and the water phase which is introduced into the upper portion of the water-wash column countercurrently contacting the raffinate phase therein. A solvent-rich stream, substantially free from hydrocarbons is withdrawn from the bottom of the solvent recovery column. The greater proportion thereof is introduced into the top of the solvent extraction zone to countercurrently contact the mixed hydrocarbon feed stream. A relatively minor portion of the solvent recovery bottoms material is often diverted and introduced into a solvent regenerator, the regenerated solvent generally being combined with the solvent feed to the extraction zone.

In accordance with the present invention, the solvent-rich extract stream from the extraction zone is introduced into the stripping zone through two separated loci. The minor proportion is introduced into the upper locus after being commingled with the substantially hydrocarbon-free solvent recovered as a bottoms stream from the recovery column. From about 60.0 to about 95.0% (by volume) is introduced through the lower of the two loci. As a result of this technique, the stripper overhead vaporous stream is significantly reduced in aromaticity by virtue of the selective aromatic absorption which occurs in this top portion of the stripping column. The extract phase feed loci are separated by 10.0 to 30.0% of the total number of trays (or decks) in the stripping column. For example, in a column having 50 trays, with the upper locus being at the first tray, the second locus will be disposed from five to 15 trays further down the column. The stripper overhead vaporous stream is condensed, introduced into an overhead receiver and therein separated into a hydrocarbon phase, substantially free from aromatics, and a water/-solvent phase. The former is employed as reflux to the bottom of the extraction zone; since there has been a reduction in the aromaticity of this reflux stream, the "load" imposed upon the extraction zone is decreased and separation efficiency is increased. Also, in view of the fact that a lesser quantity of hydrocarbons is distilled overhead, there is afforded a reduction in utilities, or energy savings. By splitting the feed (extract phase from the solvent extraction zone) to the stripping column, with from 60.0 to about 95.0% being introduced through the lower of the two separated loci, there is effected a significant reduction in the size of the hydrocarbon phase recovered from the stripper overhead receiver and returned to the lower portion of the extraction zone as reflux. Simultaneously, there is achieved a low level of non-aromatic hydrocarbons in the final extracted product.

The water/solvent phase from the stripper overhead receiver is conveniently commingled with the solvent-containing water stream emanating from the raffinate water-wash column and introduced into a water stripping column. Hydrocarbons (non-aromatics) and 5.0 to b 20.0% of the water are stripped from the solvent, the remainder being employed as the stripping medium in the lower section of the solvent recovery column. Generally, in present-day processes this stream is combined with the lean solvent return to the extraction zone. As a result of its use as a stripping medium, the lean solvent bottoms stream from the recovery column, being recycled to the extraction zone is virtually completely free from hydrocarbons. From about 5.0 to about 30.0% (by volume) of the lean solvent stream is combined with the greater proportion of the extract phase being introduced into the upper locus of the stripping column.

SOLVENTS AND OPERATING CONDITIONS

Generally accepted solvents, having solubility selectivity for aromatic hydrocarbons, are water-soluble, oxygen-containing organic compounds. In order to be effective in a solvent extraction system, such as the process provided by the present invention, the solvent component must have a boiling point substantially greater than water, added to the solvent composition for enhancing its selectivity, and, in general, must also have a boiling point substantially greater than the end boiling point of the hydrocarbon feedstock. The solvent composition generally has a density greater than the hydrocarbon feedstock and is, accordingly, introduced into the uppermost portion of the solvent extraction zone, thereafter flowing downwardly, countercurrent to the rising hydrocarbon feedstock.

Organic compounds suitable as the solvent component may be selected from the relatively large group of compounds characterized generally as oxygen-containing compounds, particularly the aliphatic and cyclic alcohols, the glycols and glycol ethers, as well as glycol esters. The mono- and polyalkylene glycols in which the alkylene group contains from about two to about four carbon atoms, such as ethylene glycol, diethylene glycol, triethylene glycol and tetraethylene glycol, propylene glycol, dipropylene glycol, and tripropylene glycol constitute a particularly preferred class of organic solvents useful in admixture with water. Another particularly suitable class of selected solvents are those commonly referred to as the sulfolane-type. By this, we intend a solvent having a five-membered ring, one atom of which is sulfur, the other four being carbon and having two oxygen atoms bonded to the sulfur atom. The four carbon atoms may be linked with hydrogen or alkyl groups. Other solvents preferably included are the sulfolenes such as 2-sulfolene or 3-sulfolene.

The solvent generally contains a small amount of dissolved water to increase the selectivity of the solvent for aromatic hydrocarbons over non-aromatic hydrocarbons without substantially reducing the solubility of the solvent phase for the aromatic hydrocarbons. The presence of water in the solvent composition provides a relatively volatile material which is distilled from the fat solvent in the stripping column to vaporize the last traces of non-aromatic hydrocarbons by way of steam distillation. The solvent composition contains from about 0.3 to about 25.0% by weight of water, depending upon the particular solvent employed and the process conditions under which the various major vessels are operated. By including water in the solvent composition, the solubility of aromatic hydrocarbons in the solvent, although somewhat reduced in comparison with a non-aqueous solvent, greatly decreases the solubility of non-aromatic raffinate components in the solvent and also reduces the solubility of solvent in the raffinate stream. Although the quantity of solvent in the raffinate at any given instance is relatively small, the cumulative effect of small amounts of solvent in a stream removed from the process flow and thus otherwise lost, greatly reduces the efficiency and economy of the solvent extraction process. The recovery of solvent from the raffinate stream can be accomplished efficiently by countercurrently washing the same with water in a separate washing zone from which an aqueous wash effluent is recovered containing the solvent.

The solvent extraction zone is maintained at conditions of temperature and pressure selected to maintain the solvent and hydrocarbons in liquid phase. Suitable temperatures are within the range of from about 80° F. (26.7° C.) to about 400° F. (204° C.), and preferably at an intermediate level in the range of about 150° F. (65° C.) to about 300° F. (149° C.). The extraction zone will generally function at a pressure from about atmospheric to about 400 psig. (28.22 atm.), and preferably from about 50 psig. (4.41 atm.) to about 150 psig. (11.21 atm.).

The stripping column is generally maintained at moderate pressures and sufficiently high temperatures to produce an overhead stream containing all the non-aromatic hydrocarbons. Typical pressures are in the range of about atmospheric to about 50 psig. (4.41 atm.) although the pressure at the top of the stripper is generally maintained at a level of about 5.0 psig. (1.34 atm.) to about 20.0 psig (2.36 atm.). Suitable operating temperatures are within the range of about 225° F. (107° C.) to 400° F. (204° C.). Solvent recovery is effected at temperatures ranging from about 130° F. (54° C.) to about 375° F. (191° C.). The recovery column will function at a pressure less than 1.0 atmosphere, and generally at a level of about 80 mm. Hg., absolute to about 700 mm. Hg., absolute.

The water-wash column, utilized to remove solvent from the non-aromatic raffinate, will function at a relatively low pressure of about 30 psig. (3.04 atm.) to about 75 psig. (6.10 atm.). Moderate temperatures are also employed, and will range from about 70° F. (21.1° C.) to about 130° F. (54° C.). The water-stripping column is maintained at temperatures in the range of about 200° F. (93° C.) to about 300° F. (149° C.), and pressures from about atmospheric to about 20 psig. (2.36 atm.).

Other operating conditions will be given in conjunction with the description of the present invention as illustrated in the accompanying drawing. Miscellaneous appurtenances, not believed required by those possessing the requisite expertise in the appropriate art, have been eliminated from the drawing. The use of details such as pumps, compressors, controls and instrumentation, heat-recovery circuits, valving, start-up lines and similar hardware, etc., is well within the purview of those skilled in the art. It is understood that the illustration as presented is not intended to limit my invention beyond the scope and spirit of the appended claims.

DESCRIPTION OF DRAWING

With reference to the drawing, which presents the illustration as a simplified diagrammatic flow scheme, it will be noted that only the major separation vessels are shown. These are: stripping column 2 and the stripper overhead receiver 8; the solvent recovery column 6 and the recovery column overhead receiver 16; water-stripping column 10; and, solvent regenerator 25. Further description of the present invention will be made in conjunction with a commercially-scaled system designed to process approximately 6,600 Bbl/day (43.72 $M^3$/hr) of an aromatic-rich blend of pyrolysis naphtha and coke oven light oil. The feedstock has a molecular weight of about 83.5 lb/mole, and contains about 88.1% by volume aromatics, 6.1% paraffins and 5.8% naphthenes, having six to about nine carbon atoms per molecule.

It is understood that the precise manner by which the aromatics are extracted from the fresh charge stock is not essential to our separation method, a brief description thereof appears warranted for the sake of completeness. An aromatic-rich charge stock, in an amount of about 974.50 lb-moles/hr. (442.96 kg-moles/hr.) is introduced into a solvent extraction zone through an intermediate locus thereof. In an operating commercial system, a plurality of feed loci is provided to afford flexibility in adjusting for changes in feed rate and aromatic/non-aromatic feed ratios. Solvent, in this case an aqueous solution of sulfolane, is introduced through an upper locus, in the amount of about 3,894.72 lb-moles/hr. (1,770.33 kg-moles/hr.). The extractor is maintained at a top temperature of about 210° F. (99° C.), a top pressure of about 75 psig. (6.10 atm.), a bottom temperature of about 183° F. (85° C.) and a bottom pressure of about 115 psig. (8.23 atm.). A bottoms reflux stream, the source of which is hereinafter set forth, is introduced at a temperature of about 115° F. (46° C.), in the amount of about 832.75 lb-moles/hr. (378.52 kg-moles/hr.).

A non-aromatic raffinate stream, in the amount of about 100.01 lb-moles/hr. (45.46 kg-moles/hr.), is withdrawn as an overhead stream from the extractor and introduced, after cooling, into a water-wash column at a temperature of about 100° F. (37.8° C.) and a pressure of about 60 psig. (5.08 atm.). A solvent-rich aromatic concentrate, in the amount of about 5,601.96 lb-moles/hr. (2,546.35 kg-moles/hr.) is withdrawn from the extraction zone. The raffinate stream is countercurrently contacted with a water stream in the amount of about 396.47 lb-moles/hr. (180.21 kg-moles/hr.). Net non-aromatic raffinate, substantially free from solvent, in the amount of 98.64 lb-moles/hr. (44.84 kg-moles/hr.), is recovered and transported thereby to suitable storage facilities. A water stream, in the amount of about 397.83 lb-moles/hr. (180.83 kg-moles/hr.), containing about 1.34 lb-moles (0.62 kg-moles) of sulfolane, is recovered.

Specifically referring now to the drawing, the 5,601.96 lb-moles/hr. (2,546.35 kg-moles/hr.) of solvent-rich extract material (approximately 69.5% water and sulfolane) are introduced into the separation facility by way of line 1, and 4,761.66 lb-moles (2,164.39 kg-moles) are diverted through line 3 into stripping column 2. Lean solvent from line 4, in the amount of 432.74 lb-moles/hr. (196.70 kg-moles/hr.), is added to the remaining 840.03 lb-moles (381.95 kg-moles) of the extract, the mixture continuing through line 1 into column 2. In this illustration, about 10 fractionation trays separate the loci through which the two streams are introduced. Furthermore, stripper 2 is the external reboiler type as contrasted to one wherein a vaporous stripping medium is introduced directly into the reboiled section from a different source. Stripper 2 functions at a top temperature of about 245° F. (118° C.) and a top pressure of about 13.0 psig. (1.88 atm.), and a bottom temperature of 335° F. (168° C.) and a bottom pressure of 18.0 psig. (2.22 atm.).

Stripper overhead vapors, of which about 9.5% is sulfolane and water, in an amount of 912.20 lb-moles/hr. (414.95 kg-moles/hr.) are withdrawn via line 7 and admixed with about 63.95 lb-moles/hr. (29.07 kg-moles/hr.) of water vapor from line 9. The mixture is condensed and introduced into stripper overhead receiver 8. Stripper bottoms material, substantially free from non-aromatic hydrocarbons, is recovered through line 5, in the amount of about 5,121.80 lb-moles/hr. (2,328.09 kg-moles/hr.), and introduced thereby into solvent recovery column 6. This column is maintained at conditions of temperature and pressure which are sufficient to provide a substantially solvent-free aromatic overhead product in line 15. In this illustrative example, the recovery column functions at a top temperature of about 145° F. (63° C.), a top pressure of about 283 mm. Hg., absolute (0.37 atm.), a bottom temperature of about 337° F. (169° C.) and a bottom pressure of about 450 mm. Hg., absolute (0.59 atm.). The aromatic stream, containing water, is recovered in an amount of 1,272.32 lb-moles/hr. (578.33 kg-moles/hr.) through line 15, condensed and introduced into recovery column overhead receiver 16. An aromatic concentrate, in the amount of 875.95 lb-moles/hr. (398.11 kg-moles/hr.) is recovered by way of line 17 and transported thereby to suitable fractionation facilities for the recovery of the individual aromatic components. Water is withdrawn through dip-leg 18, in the amount of about 396.47 lb-moles/hr. (180.21 kg-moles/hr.), and introduced, via line 19 into the raffinate water-wash column previously described.

Referring now to stripper overhead receiver 8, the feed thereto constitutes 63.95 lb-moles/hr. (29.07 kg-moles/hr.) of water, withdrawn as an overhead vapor in line 9 from water stripper 10, and 912.90 lb-moles/hr. (414.95 kg-moles/hr.) of stripping column 2 overhead vapors in line 7. Receiver 8 effects a phase separation whereby the hydrocarbon portion is removed via line 11 to be introduced into the extraction zone as a bottoms reflux stream. A concentrated water stream, containing about 1.2% by volume of sulfolane, is withdrawn from dip-leg 12 through line 13, in the amount of 144.10 lb-moles/hr. (65.50 kg-moles/hr.). The water from the raffinate water-wash column, in the amount of 397.83 lb-moles/hr. (150.70 kg-moles/hr.), is admixed via line 14, and the mixture continues through line 13 into an upper portion of water-stripping column 10.

Water stripper 10 functions at a top temperature of about 230° F. (110° C.), a top pressure of about 6.0 psig. (1.41 atm.), a bottom temperature of about 250° F. and a bottom pressure of about 7.0 psig. (1.48 atm.). Overhead vapors, in an amount of 63.95 lb-moles/hr. (29.07 kg-moles/hr.) and containing some non-aromatic hydrocarbons, are withdrawn through line 9, condensed and introduced into stripper receiver 8, in admixture with stripping column 2 overhead vapors. Heat-input to water stripper 10 is supplied by way of indirect heat-exchange with a lean solvent stream introduced via conduit 21 into the reboiler section, in the amount of 3,678.34 lb-moles/hr. (1,671.97 kg-moles/hr.), and exiting therefrom through conduit 23. Stripping vapors, in an amount of 477.98 lb-moles/hr. (217.26 kg-moles/hr.) are withdrawn through line 28 and introduced thereby directly into the lower portion of recovery column 6. The principle purpose of this technique is to maintain the lean solvent concentrate in line 20, in the amount of 4,327.45 lb-moles/hr. (1,967.03 kg-moles/hr.) virtually completely free from aromatic hydrocarbons which otherwise would be introduced into the extraction zone, or into stripping column 2. As little as 0.5% aromatics in this stream will have an adverse effect upon the efficiency of separation above the feed locus in the extraction zone. Either periodically, or on a continuous basis, a portion of the solvent-rich stream in line 21 is diverted through line 24 and introduced into solvent regenerator 25 which functions at a top temperature of about 350° F. (177° C.) and a top pressure of about 520 mm. Hg., absolute (0.68 atm.). Regenerated solvent is recovered overhead through line 26; as generally practiced in current systems, this stream will be admixed with the lean solvent in line 23 for introduction therewith into the extraction zone. Deteriorated solvent, tars and other impurites are removed from the proces via line 27. A portion, 432.74 lb-moles/hr. (196.70 kg-moles/hr.) of this 4,327.46 lb-moles/hr. (1,967.03 kg-moles/hr.) of lean solvent in line 23 are diverted through line 4 to be combined with the portion of the extract phase entering stripper 2, via line 1 through the upper locus. The remaining 3,894.72 lb-moles/hr. (1,770.33 kg-moles/hr.) continue through line 23 to the solvent extraction zone.

As previously stated, and as indicated in the foregoing description of the accompanying drawing, our invention involves the double technique of (1) introducing the extract phase into the stripping column in two portions through separated loci, and commingling lean solvent with the larger portion which is introduced through the upper locus, and, (2) introducing an internally-prepared, substantially pure solvent/water stripping medium into a locus in the lower portion of the recovery column. A principal advantage resides in decreasing the load imposed upon the extraction zone by (1) decreasing significantly the quantity of aromatics unnecessarily returned with the stripper overhead employed as lower reflux and, (2) providing a solvent stream virtually completely free from aromatic hydrocarbons for recycle to the extraction zone. Additionally, there is afforded an enhancement of the non-aromatic/aromatic separation in the upper section of the stripping column.

We claim as our invention:

1. A method for separating polar hydrocarbons from a mixture thereof with non-polar hydrocarbons and a solvent characteristically selective for absorbing polar hydrocarbons, which method comprises the steps of:

(a) introducing a first portion of said mixture into a first fractionation column, through a first locus in the upper portion thereof, and simultaneously introducing a greater second portion of said mixture through a second locus in the upper portion of said first column, said second locus being below said first locus;

(b) removing a non-polar hydrocarbon stream from said first fractionation column, through a third locus disposed above said first locus and withdrawing a solvent-rich, polar hydrocarbon-containing stream through a fourth locus in the lower portion of said first column;

(c) introducing at least a portion of said solvent-rich, polar hydrocarbon-containing stream into a second fractionation column, through a first locus in the upper portion of said second column, removing a polar hydrocarbon-rich stream, substantially free from solvent and non-polar hydrocarbons, through a second locus in the upper portion thereof, said second locus being above said first locus, introducing a vaporous stripping medium through a third locus in the lower portion of said second column, and withdrawing a solvent-rich stream, substantially free from hydrocarbons, through a fourth locus disposed below said third locus; and, (d) introducing at least a portion of said solvent-rich stream into said first fractionation column through said first locus in admixture with the first portion of said mixture.

2. The method of claim 1 further characterized in that from about 5.0 to about 40.0% of said mixture is introduced into said first fractionation column through said first locus.

3. The method of claim 1 further characterized in that from about 5.0 to about 30.0% of said solvent-rich stream is introduced into said first fractionation column through said first locus.

4. The method of claim 1 furher characterized in that said vaporous stripping medium is substantially hydrocarbon-free solvent.

5. The method of claim 1 further characterized in that said polar hydrocarbons are aromatic.

6. The method of claim 1 further characterized in that said solvent is a sulfolane-type organic compound.

7. The method of claim 1 further characterized in that said solvent is a polyalkylene glycol.

8. A process for the recovery of aromatic hydrocarbons from a mixture thereof with non-aromatic hydrocarbons, which process comprises the sequential steps of:

(a) introducing said mixture into an extraction zone and therein contacting said mixture with a solvent characteristically selective for absorbing aromatic hydrocarbons, at conditions selected to maintain said mixture and solvent in liquid phase;

(b) removing a non-aromatic raffinate stream from said zone, through an upper locus thereof, and an aromatic hydrocarbon, solvent-rich extract stream from a lower locus of said zone;

(c) introducing a first portion of said extract stream into a stripping column, through a first locus in the upper portion thereof, and simultaneously introducing a greater second portion of said extract stream through a second locus in the upper portion of said stripping column, said second locus being below said first locus;

(d) removing a non-aromatic solvent-containing stream from said stripping column, through a third locus disposed above said first locus, and withdrawing a solvent-rich, aromatic-containing stream through a fourth locus in the lower portion of said column;

(e) introducing at least a portion of said solvent-rich, aromatic-containing stream into a recovery column, through a first locus in the upper portion of said column, removing an aromatic-rich stream, substantially free from solvent and non-aromatic hydrocarbons, through a second locus disposed above said first locus, introducing a vaporous stripping medium through a third locus in the lower portion of said recovery column, and withdrawing a solvent-rich stream, substantially free from hydrocarbons, through a fourth locus disposed below said third locus;

(f) introducing a first portion of said solvent-rich stream into said stripping column through said first locus in admixture with the first portion of said extract stream, and recycling a second portion of said solvent-rich stream to said extraction zone; and, (g) recovering solvent from the non-aromatic solvent-containing stream, removed from said stripping column, and introducing the recovered solvent into said recovery column as said stripping medium.

9. The process of claim 8 further characterized in that said solvent is a sulfolane-type organic compound.

10. The process of claim 8 further characterized in that said solvent is a polyalkylene glycol.

* * * * *